US011083925B2

(12) United States Patent
Ciccarone et al.

(10) Patent No.: US 11,083,925 B2
(45) **Date of Patent: *Aug. 10, 2021**

(54) PLIABLE OBJECT WRAPPING DEVICE FOR ACTIVATING AND EXERCISING MUSCLES AND METHOD OF ACTIVATING AND EXERCISING

(71) Applicant: LacedUp Athletics LLC, Wayne, PA (US)

(72) Inventors: Jay Ciccarone, Wayne, PA (US); Anthony Doyle, Jr., Spring City, PA (US)

(73) Assignee: LACEUP ATHLETICS LLC, Wayne, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/917,036

(22) Filed: Mar. 9, 2018

(65) Prior Publication Data

US 2018/0256934 A1 Sep. 13, 2018

Related U.S. Application Data

(63) Continuation-in-part of application No. 15/457,696, filed on Mar. 13, 2017.

(51) Int. Cl.
*A63B 23/12* (2006.01)
*A63B 21/065* (2006.01)
(Continued)

(52) U.S. Cl.
CPC ..... *A63B 21/065* (2013.01); *A63B 60/02* (2015.10); *A63B 69/0002* (2013.01);
(Continued)

(58) Field of Classification Search
CPC ..... A63B 21/0607; A63B 21/4013; A63B 21/065; A63B 21/4021
See application file for complete search history.

(56) References Cited

U.S. PATENT DOCUMENTS 3,006,646 A 10/1961 Nanni
4,192,502 A 3/1980 Owen
(Continued)

FOREIGN PATENT DOCUMENTS

EP 1 832 184 A1 9/2007
GB 1 568 081 A 5/1980
(Continued)

OTHER PUBLICATIONS

Website: https://www.thomassci.com/Laboratory-Supplies/Lead-Rings/_/VINYL-COATED-LEAD-WIREAND- SHEETS Archived: Aug. 7, 2016 Retrieved: Jun. 18, 2018.*
(Continued)

*Primary Examiner* — Megan Anderson
(74) *Attorney, Agent, or Firm* — Brooks Kushman P.C.

(57) ABSTRACT

A muscle activating and exercising device and a method of activating and exercising muscles of the human body. The device includes an outer material and at least one flexible inner material. The device is an elongated device that is pliable enough to be wrapped around an object. The device also has an outer surface that creates a frictional fit between the device and the wrapped object. The wrapped object could be, for example, a wrist or ankle on a human limb or a location on a portion of sports equipment (e.g., a lacrosse stick, baseball bat, hockey stick, golf club or tennis racket). The method includes a method of activating muscles using the device. Through such a method, a user can, for example, build muscle strength and/or reduce muscle tremors.

12 Claims, 9 Drawing Sheets

(51) Int. Cl.

| | |
|---|---|
| ***A63B 69/00*** | (2006.01) |
| ***A63B 69/38*** | (2006.01) |
| ***A63B 60/02*** | (2015.01) |
| *A63B 69/36* | (2006.01) |
| *A63B 102/02* | (2015.01) |
| *A63B 102/14* | (2015.01) |
| *A63B 102/32* | (2015.01) |

(52) U.S. Cl.
CPC ..... *A63B 69/38* (2013.01); *A63B 69/3638* (2013.01); *A63B 2069/0008* (2013.01); *A63B 2102/02* (2015.10); *A63B 2102/14* (2015.10); *A63B 2102/32* (2015.10)

(56) References Cited

U.S. PATENT DOCUMENTS

| | | | | |
|---|---|---|---|---|
| 4,369,967 | A * | 1/1983 | Kimura | A63B 21/065 482/105 |
| 4,623,143 | A | 11/1986 | Wuellenweber | |
| 5,072,935 | A * | 12/1991 | McWain | A63B 21/0602 224/148.1 |
| 5,316,531 | A * | 5/1994 | Spence | A63B 15/00 482/106 |
| 5,978,964 | A * | 11/1999 | Gaston | A63B 21/065 2/228 |
| 5,980,397 | A | 11/1999 | Hart et al. | |
| 6,379,286 | B1 | 4/2002 | Scopino et al. | |
| 7,383,588 | B2 * | 6/2008 | Victor | A41D 20/00 2/16 |
| 7,704,198 | B2 * | 4/2010 | Brown, Jr. | A63B 21/028 482/121 |
| 8,038,585 | B1 | 10/2011 | Brown, Jr. | |
| 8,231,510 | B2 | 7/2012 | Abdo | |
| 8,821,356 | B2 | 9/2014 | Burke | |
| 9,314,660 | B1 | 4/2016 | Welch | |
| 2003/0130070 | A1 | 7/2003 | Nolan | |
| 2004/0259666 | A1 * | 12/2004 | Bjugstad | A63B 21/065 473/437 |
| 2007/0207903 | A1 | 9/2007 | Csabai | |
| 2008/0108457 | A1 | 5/2008 | Hansen et al. | |
| 2009/0205106 | A1 | 8/2009 | Sohn et al. | |
| 2010/0064413 | A1 * | 3/2010 | Koelle | A41D 13/0015 2/113 |
| 2011/0275458 | A1 | 11/2011 | Estrada et al. | |
| 2014/0113777 | A1 * | 4/2014 | Pahl | A63B 21/4043 482/93 |
| 2014/0121075 | A1 * | 5/2014 | Brown | A63B 21/026 482/106 |
| 2014/0190623 | A1 * | 7/2014 | Bradford | A63B 71/0054 156/185 |
| 2016/0082342 | A1 * | 3/2016 | Brown | A63B 71/143 2/20 |
| 2017/0021223 | A1 * | 1/2017 | Ramsey | A63B 21/0724 |
| 2017/0073514 | A1 * | 3/2017 | Kurup | C08L 67/025 |
| 2018/0221738 | A1 | 8/2018 | Panozzo | |

FOREIGN PATENT DOCUMENTS

| | | | |
|---|---|---|---|
| GB | 2222092 | B | 7/1992 |
| GB | 2 293 116 | A | 3/1996 |
| JP | 2007/044316 | A | 2/2007 |
| WO | WO 1985/001219 | A1 | 3/1985 |

OTHER PUBLICATIONS

Website: https://www.livestrong.com/article/493618-diabetics-hand-tremors/ Archived: Dec. 9, 2016 Retrieved: Jun. 14, 2018.
"Training Lace." LaceUp Athletics, Training Lace, Oct. 11, 2017, web.archive.org/web/20171011232259/https://traininglace.com/.
International Search Report and Written Opinion issued in corresponding International Application No. PCT/US2018/021791 dated May 29, 2018.

* cited by examiner

PLIABLE OBJECT WRAPPING DEVICE FOR ACTIVATING AND EXERCISING MUSCLES AND METHOD OF ACTIVATING AND EXERCISING

CROSS-REFERENCE TO RELATED APPLICATIONS

This application is a continuation-in-part of U.S. patent application Ser. No. 15/457,696, filed on Mar. 13, 2017, which is hereby incorporated by reference in their entirety.

BACKGROUND OF THE INVENTION

When strengthening and otherwise calling for one's muscles to be used or otherwise activated, users often use one of a various selection of weighted apparatuses. Examples of such apparatuses include dumbbells, weighted rings, barbell plates, kettle bells, medicine balls, and an array of other apparatuses. Depending upon the muscles to be exercised or otherwise activated, the user may select to use a weight apparatus of a certain weight, configuration, size and contact surface. For example, one might use weighted wrapping bands on wrists and/or ankles in one's efforts to activate and exercise the limbs to which such apparatuses are attached. Conversely, an athlete might use a weighted ring on his or her sports equipment, be it a bat, lacrosse stick, golf club, hockey stick, or other hand held equipment, to activate and exercise the muscles that operate and move the equipment.

A user may wish to exercise and/or activate their muscles, and with an aim of strengthening, to improve athletic performance in a "game situation" by exercising using movements that simulates "game play". By way of example, baseball players are known to take practice swings with weighted rings at the ends of their bats. Similarly, users of lacrosse sticks, tennis rackets, golf clubs, and similar sports equipment may use weighted versions or otherwise add weights to standard versions of such sports equipment for practice movements that call for them to activate and exercise their muscles more than normal. At times, it is preferable, for example, for a baseball player to take live batting practice or for a lacrosse player to run through game-like drills with a weighted version of their normal equipment.

The problem with the existing art in this area is that the weights used with such muscle activation and exercising (e.g., weights directly attached to limbs or to sports equipment) typically are not variable in their location (e.g., ring weights position themselves where their inner diameters are the same as the outer diameters of the portion of the sports equipment they encompass) and tend to have the freedom to move in undesirable ways when used (e.g., in relation to the hand or foot or along the length of the applicable sports equipment).

At other times, instead of positioning the weight around one's wrist, for example, users hold weights in their hands to activate and/or exercise the muscles of their arms and upper bodies. For example, a jogger may hold a set of dumbbells in his or her hands to give himself or herself a more intense workout while running. In the medical world, people who suffer from tremors may hold weights in their hands to activate and/or exercise muscles, aiding in the reduction or elimination of such tremors. One problem here, however, is that holding of weight in the hands activates and/or exercises additional muscles (e.g., hand and finger muscles) and does not give the user the freedom to use his or her hands for other purposes during such times.

An additional shortfall of prior art apparatuses is their inability to be wrapped around objects with relatively small circumferences and still fit snugly to such objects. Oftentimes the weights are also sized for a specific and predetermined circumference, which does not allow for variability in the size of the object with which the weights can be used or the location at which the weights can be attached. Thus, it would be advantageous to provide a device that has variable wrapping characteristic, which would support, for example, the positioning of the weighted device at a user's desired location along the length of sports equipment or on the wrist or ankles of a user of almost any size. The characteristics of the materials used in the construction of such a weighted device, and the design of the device, would, by necessity, dictate the device's pliability (e.g., its capacity to be used effectively at locations of an object of varying circumferences and with separate objects of varying circumferences).

Prior art apparatuses address some of the needs of users to activate and/or exercise muscles, but such apparatuses also have shortcomings. For example, the apparatus in U.S. Pat. No. 4,369,967A can be attached to or wrapped around an object, but it is limited in its variability in accommodating, in one configuration of the apparatus, objects of various circumferences and placement at various locations of such objects. The design and configuration of its core does not suggest ample pliability, while the apparatus as a whole also fails to suggest the ability to stay fixed to an object at different locations (e.g., apply and maintain a sufficient force when wrapped at various locations) during exercise or use (e.g., preventing movement when exercising).

Another such apparatus, as shown in GB2293116A, suggests a tubular weight. In this case, weights are added to the inner tube and are closed by encapsulating end caps. Yet again, however, the reference does not suggest that the core has an adequate level of pliability or that the device is capable of staying fixed to an object at various locations during use. Additionally, use of the apparatus as well as manipulation of the varying weights appears overly tedious.

Further, U.S. Pat. No. 5,316,531A appears to show a tubular weight with a foam rubber cover. Weight elements are shown as added to the inner tube to increase the overall weight of the apparatus. Like the other two referenced apparatuses described above, this device also seems to lack the pliability needed to foster the use of the device in a wide variety of situations. Accordingly, although these and other prior art references describe weights being able to be wrapped around an object (legs, arms, wrist, or any tubular objects), many are structured as flat casings with inserted weights (sand, small metal weights) and are wrapped around an object and attached by separate means (Velcro, strings, etc.). The prior art includes devices that appear relatively cumbersome to use and to secure in place, with the apparent possibility of constant undesirable movement or transfer of the weight along the length of the attachment location during use.

SUMMARY OF THE INVENTION

The invention, in general, comprises a device configured in an elongated form that includes a sturdy but flexible inner material. In preferred embodiments of the invention, the inner material is at least one lead rod or such other elements with substantially similar characteristics and properties. The flexible inner material is primarily encased in an even more flexible outer material that has an exterior surface that can engage with the surface of an object around which the device is to be attached (e.g., wrapped), at least a partially, by creating a frictional fit with the object. The connection between the device and the at least partially wrapped object, according to embodiments, is tight (e.g., reducing or eliminating movement of the device relative to the object), but not overly compressive on the object (e.g., there should be no undesirable or otherwise damaging forces imposed on the object by the device, or vise versa, during normal use and movement of the object).

In a preferred embodiment of the invention, the outer diameter of the inner material is as large as or larger than the inner diameter of the outer material. In such a configuration, a force fit connection is created between the outer surface of the inner material and the inner surface of the outer material. Such a force fit helps to reduce or eliminate the need to have an adhesive or other means of fixing the positioning of the inner material and the outer material relative to each other. According to a preferred embodiment, the inner material is configured to be surrounded in its entirety by the outer material.

According to embodiments of the invention, the device further comprises caps or closing elements to help ensure the inner material stays within the outer ends of the outer material and to ensure that the inner material is fully encapsulated.

According to embodiments of the invention, the device comprises: a plurality of flexible inner materials, each in an elongated form and having a first end and a second end; an elongated outer material surrounding the plurality of flexible inner materials having a first end and a second end, wherein the first end of the elongated member is located proximal to the first end of each of the plurality of flexible inner materials and the second end of the elongated member is located proximal to the second end of each of the plurality of flexible inner materials; a first closing element proximal to the first end of the plurality of flexible inner materials and the first end of the elongated outer material; and a second closing element proximal to the second end of the plurality of flexible inner materials and the second end of the elongated outer material.

According to embodiments, at least one of the plurality of flexible inner materials is a lead rod in the shape of a cylinder.

According to embodiments of the invention, the outer diameter of the plurality of inner materials is equal to or larger than an inner diameter of the outer material and the inner materials are positioned to be surrounded in their entirety by the outer material.

According to embodiments of the invention, the device is at least 12 inches long and is configured to wrap three (3) times around the object when the object has a diameter of one (1) inch.

According to embodiments of the invention, at least one of the inner materials is coated. According to these embodiments, the coating comprises a heat-shrinkable material.

According to embodiments of the invention, the plurality of flexible inner materials are parallel to each other. According to other embodiments, the plurality of flexible inner materials are intertwined.

According to embodiments of the invention, the device consists essentially of two flexible inner materials, each in an elongated form and having a first end and a second end; a first coating covering the first flexible inner material; a second coating covering the second flexible inner material; an elongated outer material surrounding the plurality of flexible inner materials, the first coating, and the second coating, wherein the outer material has a first end and a second end, wherein the first end of the elongated member is located proximal to the first end of each of the plurality of flexible inner materials and the second end of the elongated member is located proximal to the second end of each of the plurality of flexible inner materials; a first closing element proximal to the first end of the two flexible inner materials and the first end of the elongated outer material; and a second closing element proximal to the second end of the plurality of flexible inner materials and the second end of the elongated outer material.

According to these embodiments, each of the two flexible inner materials consists of a lead rod shaped as a cylinder. Additionally, the first coating and the second coating each consist of a heat-shrinkable material, while the outer material consists of nitrile foam rubber.

According to embodiments of the invention, the device is designed such that it can be at least partially wrapped around an object with a circumference that is greater than the circumference of the outer surface of the device (e.g. with, in most cases, the object having a circumference of 1 inch (e.g., a diameter of roughly 0.32 inches). The device is also designed such that it may be wrapped to the object at various locations using human forces no greater than those used to perform 'other every day activities' and can be unwrapped such that the device can be readily returned to its original configuration using a similar level of human forces. 'Other every day activities' may include, for example, opening ajar, turning a knob/handle, etc.

DETAILED DESCRIPTION OF THE EMBODIMENTS

Figure 1:
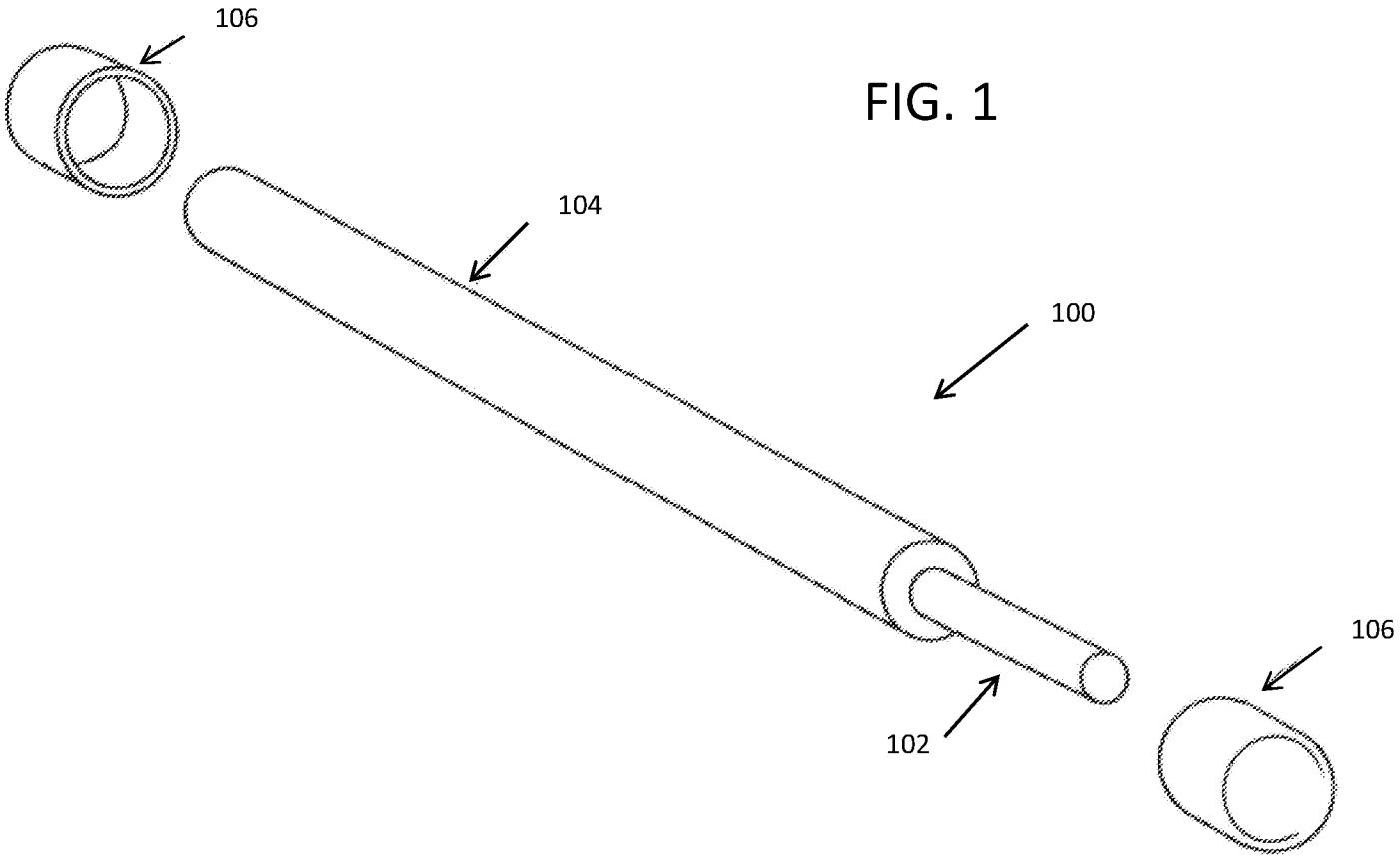
FIG. 1 is a partially exploded view of a device according to an embodiment of the invention in which the inner material is shown as protruding from the space inside of the outer material.

FIG. 1 shows a partial, exploded view of one embodiment of the present invention. Device 100 comprises inner material 102, outer material 104 and caps 106. According to an embodiment of the invention, device 100 is generally cylindrical. One of ordinary skill in the art would realize that the outer shape of device 100 may take several differing forms throughout or in portions of the outer shape. According to certain embodiments, device 100 is approximately 12 inches to 20 inches from end-to-end. The length of device 100 and its overall pliability establish the size of the object about which device 100 may be wrapped. In a preferred embodiment shown in FIG. 1, device 100 is approximately 15 inches long and has enough pliability to wrap three (3) times around an object that has a diameter of approximately one (1) inch. Accordingly, with the securing of device 100 to the target object through a frictional fit between device 100 and the wrapped surface of such object, there is no need for an additional locking mechanism (e.g., fastening lock or straps) or other encompassing covering or ballast.

It has been proven that activating and/or exercising muscles in eccentric motions increases such muscles' strength and increases the use of fast twitch muscle fibers. These increases, in turn, allow the muscles to generate more power. Device 100 allows users to create more stress on eccentric muscle movement than the non-user performing the same exercises.

One of ordinary skill in the art would realize that depending upon the pliability and length of device 100, it could be wrapped around objects having a multitude of shapes, including but not limited to cylinders, octagons, pentagons, triangles, circles, or any number of non-conforming configurations. The limitation of the objects around which device 100 can be wrapped and secured are governed primarily by the length of device 100, the overall circumference of the object to be wrapped, and how much surface area needs to be connected between the object and device 100 to limit the movement of device 100 relative to its desired position in connection with the object during movement of the object. Device 100 is also omnidirectional in that it can be manipulated in three planes.

Figure 3A:
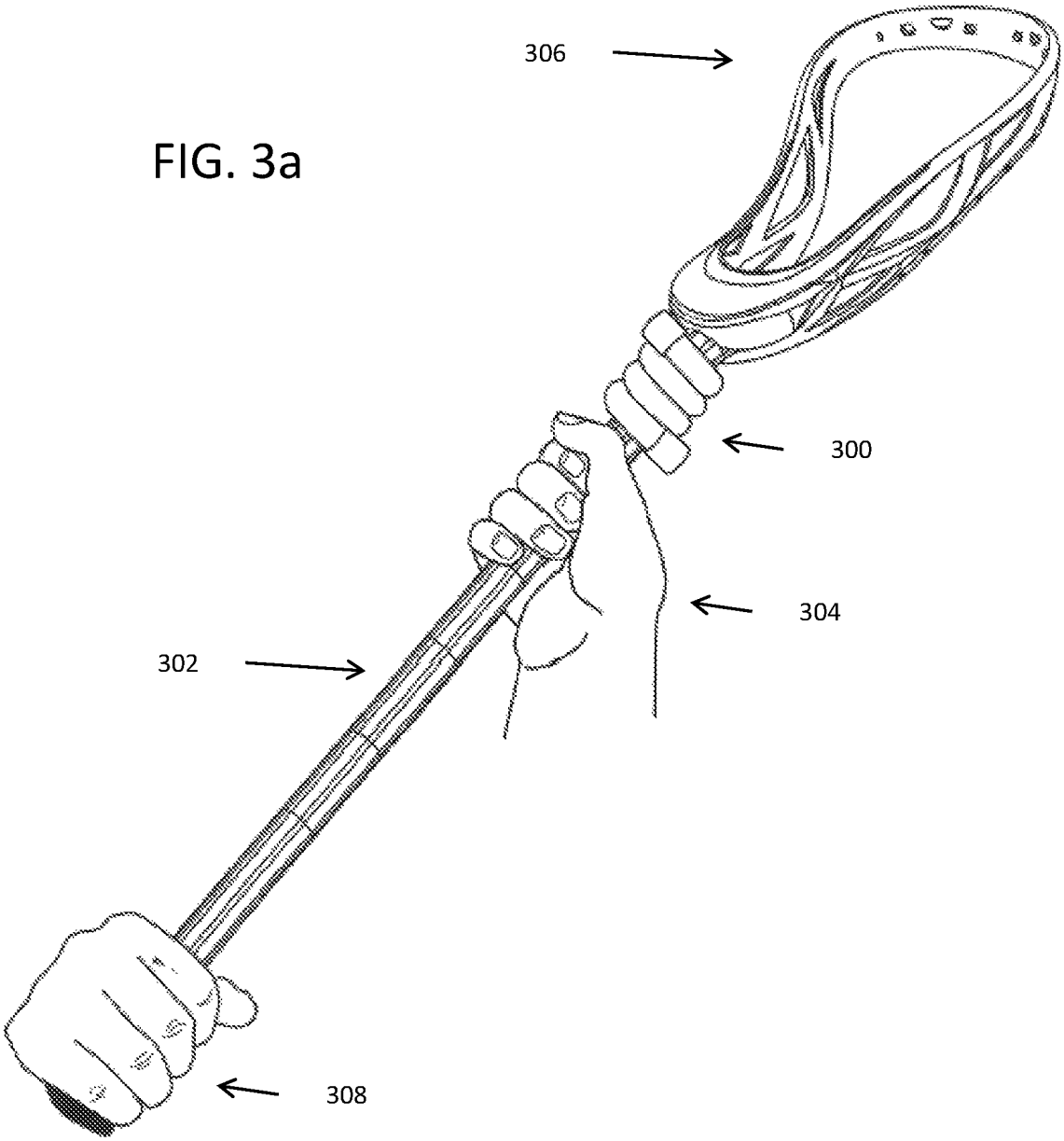
FIGS. 3*a*, 3*b*, and 3*c* are views the device attached to a lacrosse stick according to embodiments of the present invention, where the device is wrapped around upper, center and lower locations, respectively, along a stick portion of the lacrosse stick.
Figure 3B:
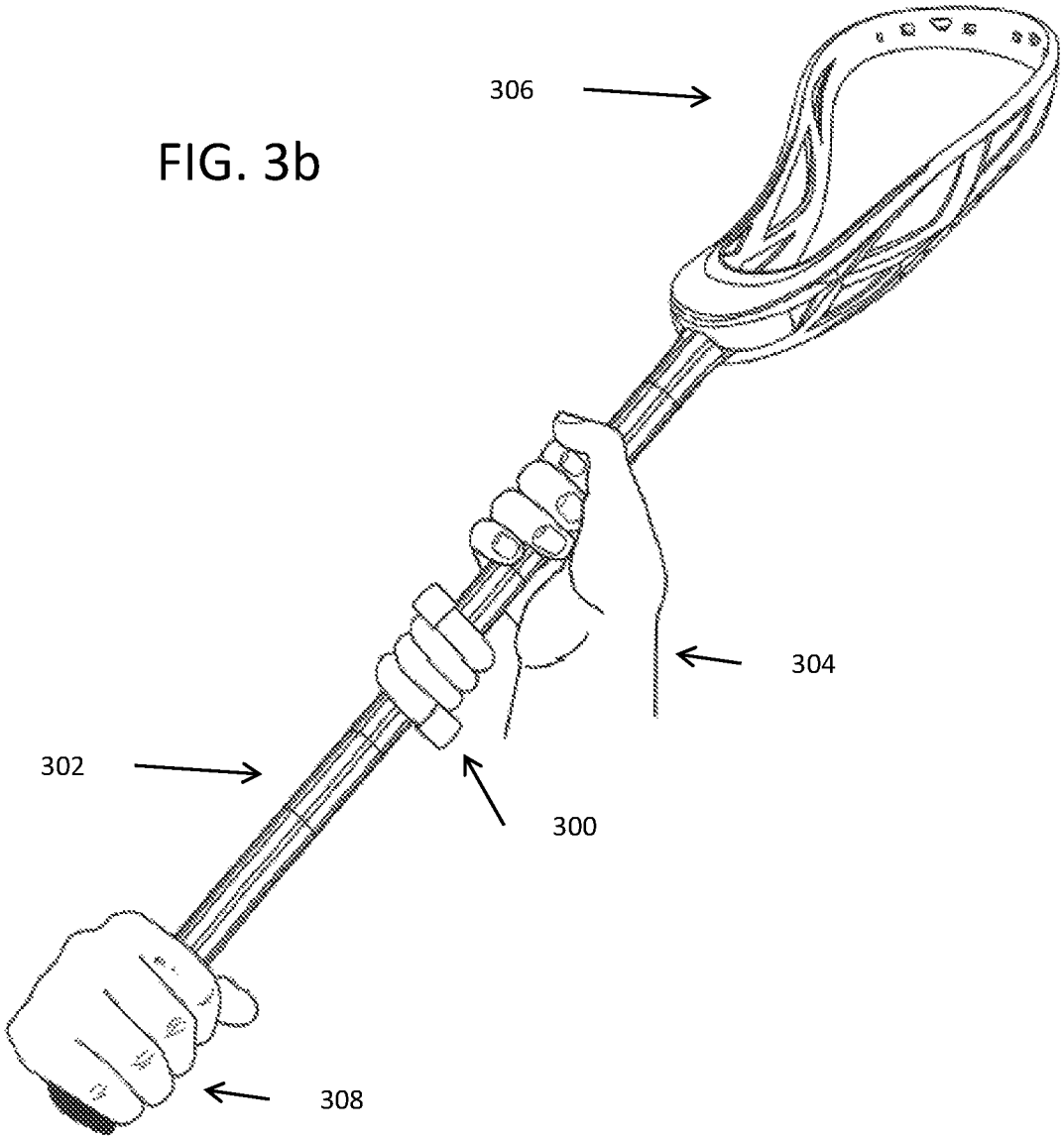
Figure 3C:
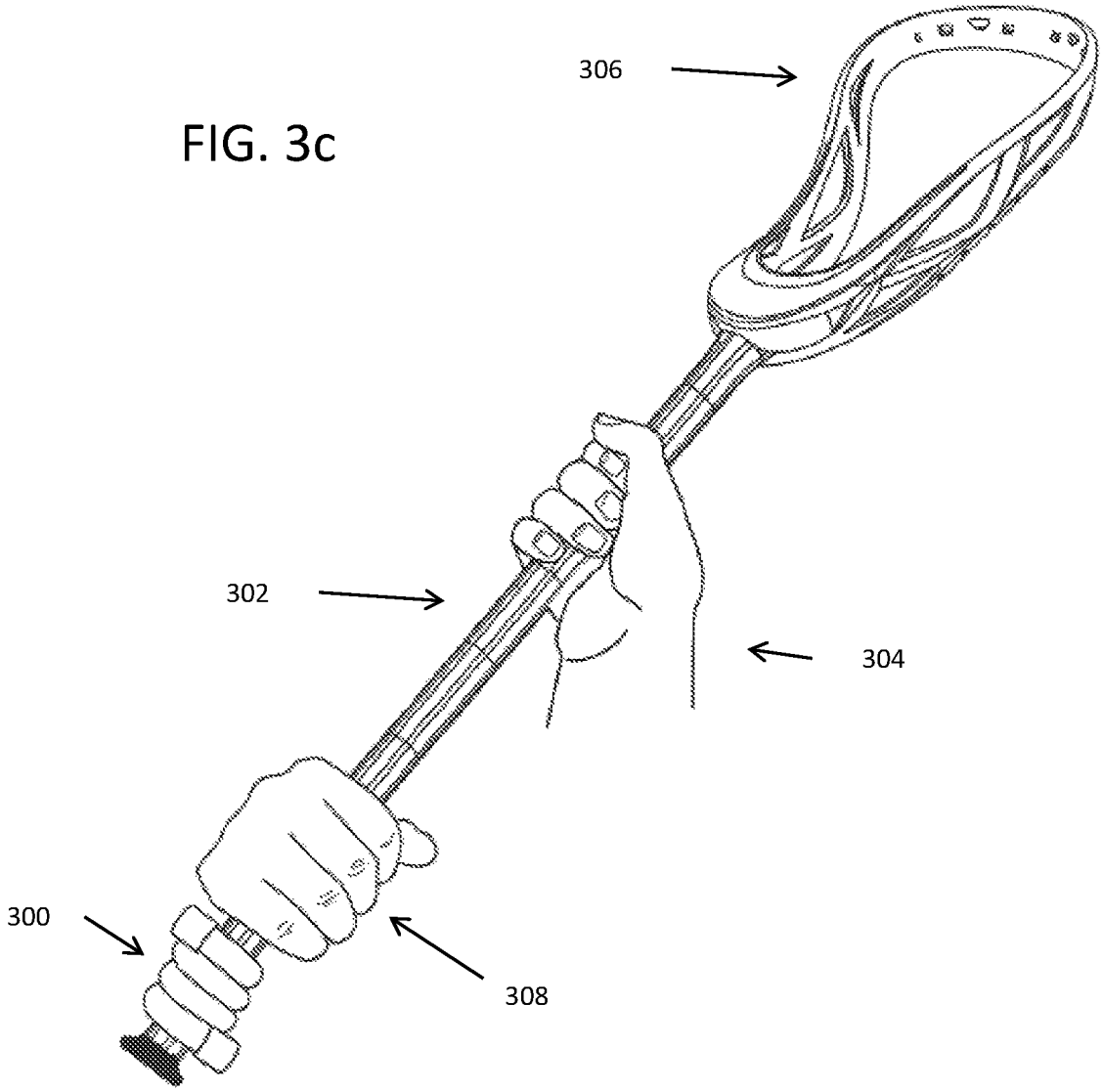

According to an embodiment, device 100 has a length of approximately 15 inches, which allows it to be wrapped three times around a regulation lacrosse stick (see, for example, FIGS. 3*a*, 3*b* and 3*c*). According to an alternative embodiment, device 100 has a length of approximately 16 inches to approximately 20 inches, which allows it to be wrapped one and one half times around a human wrist of a circumference of approximately 5 inches to approximately 8 inches (see, for example, FIGS. 4*a* and 4*b*). One of ordinary skill in the art would realize that, dependent mainly upon the weight, length and outer surface of device 100, device 100 could be also wrapped around, for example, ankles, bats, hockey sticks, tennis rackets, golf clubs and other similarly configured objects. Accordingly, the entirety of device 100 (as a unit) has a desirable level of pliability such that device 100 can be at least partial wrapped around an object with a diameter of approximately one (1) inch (e.g., a circumference of approximately 3.14 inches—if the object is in the form of a perfect circle) or more at the location of the wrapping using human forces no greater than that used to perform 'other every day activities' and can be unwrapped such that device 100 can be readily formed in a near straight lined configuration using a similar level of human forces. The connection between device 100 and the at least partial wrapped object should be tight but not overly compressive. The location of device 100, as wrapped around an object (e.g., at the end location along a length of the object as opposed at in a more central location along such length) can, as desired by a user of the object, alter the distribution of the weight of such object and device combination.

Device 100 may be used to add weight to the object around which device 100 is wrapped. For example, according to embodiments of the invention, device 100 may be wrapped around a wrist for hands-free exercising or in other manners where device 100 does not interfere with the use of the main surface of the object—a lacrosse stick, bat, golf club, hockey stick, tennis racket, etc.

The properties of device 100 allow it to be applied in different positions along a shaft, bat, racquet, stick, etc., thus allowing the user to change the center of gravity and therefore the force applied on the muscles. Adding developmentally appropriate weight and changing the center of gravity allows the body to build better proprioception and kinematic awareness during, for example, a fundamental sport movement or rehabilitation.

Device 100, according to embodiments of the invention, may be wrapped around a user's ankle. Two examples of device 100 positioned to exercise the muscles of the legs by being wrapped around the ankles are when the user is on foot (e.g., walking, jogging or running) and on a bicycle. By way of example, the wrapping of device 100 around the ankles of a user biking could foster the strengthening of the user's hip flexor through the pulling up of the weighted end of the leg as the pedal is coming up (e.g., not just during the pushing down of the end of the leg with now added force—with the extra weight of device 100).

With baseball practice, device 100 can provide an added option in its variable placement along the length of the bat. Depending upon the muscles to be activated and/or exercised, device 100, according to embodiments of the invention, of a desired weight may be positioned, for example, around the bat at the end distal from where the user is holding the bat, near the user's hands, or anywhere there between. The positioning of device 100 closer to the hands may thus reduce "casting swings"—caused by the placement of, for example, weighted rings far away from the batter's hands. The angular acceleration and centrifugal force imparted by the "casting swinging" action tends to fully extend the batter's arms prematurely due to the distance between the batter's hands and the weight. The present invention allows the user to position the weight to maximize the exercise while minimizing the influences of the "casting swing".

Tremors, sometimes mistaken for a psychological problem, find their roots in a neurological condition. About 10 million people suffer from tremors, according to the Tremor Foundation. While a person's head and voice may also be affected by tremors, a person's hands and/or legs are most likely to fall prey to these involuntary synchronizations of the muscles. Essential tremor, the most common type, stems from a neurological disorder unrelated to any disease. Illnesses that may cause tremors include Parkinson's disease, metabolic disorders, toxicity from heavy metals, or alcohol withdrawal. According to embodiments of the invention, device 100, when wrapped around a person's wrist and/or ankles—as approved by a physician, may alleviate tremors by activating and/or exercising the person's muscles in his or her arm and/or leg. It has been suggested that weights wrapped around the wrists and/or ankles may dampen the aptitude of the tremors and make the person's arm and/or leg more functional. In a small proportion of patients, the dampen down of the tremor can be enough to provide some relief or improve functioning. At least one study has also shown that weights around the wrists are effective in treating tremors with frequencies of 3 to 10 Hz.

According to certain embodiments of the invention, inner material 102 is a sturdy but flexible element such as, for example, a lead rod, with an outer dimension of approximately 0.25 inches to approximately 0.375 inch. The approximate weight of lead in these embodiment is 3-12 oz.

One of ordinary skill in the art would recognize that weight of inner material 102 selected for inclusion in device 100 may vary and will be influenced by, for example, the desired overall weight, maximum diameter, maximum circumference, overall length, and functional pliability of device 100 and the related thickness and weight of outer material 104. The end-to-end length of the lead rod in these embodiments is approximately 15 inches to approximately 20 inches. According to certain embodiments of the invention, the density of the lead rod may be consistent throughout and the weight being evenly distributed along the lead rod, but such a specification is not necessarily a requirement for the functionality of the present invention. According to alternative embodiments of the invention, the density of the lead rod may change along its length, and the weight may be unevenly distributed.

According to embodiments of the invention, the lead rod used as inner material 102 may be coated to protect the user of device 100 from unwarranted lead exposure (e.g., encased in a sealant). One of ordinary skill in the art would know that materials other than lead may be used as inner material 102, so long as those materials are of a substantially similar weight, end-to-end length and pliability. The outer dimension of such other material, which will have an impact on the relationship between the weight and pliability of the material, may be smaller or larger than the outer dimension of the lead rod discussed herein.

Outer material 104, according to embodiments of the invention, is nitrile foam rubber, NPVC or a material with substantially similar characteristics and properties. In these embodiments, outer material 104 has an inner diameter and an outer diameter of approximately 0.25 inches to approximately 0.375 inches and approximately 0.56 inches to approximately 1.25 inches, respectively. The approximate weight of nitrile foam rubber that constitutes outer material 104 in these embodiment is approximately 0.5 ounces. The end-to-end length of the nitrile foam rubber, in these embodiments, is approximately 15 inches to approximately 20 inches. The basic properties desired for outer material 104 are flexibility (at least in the range of the flexibility of inner material 102) and suppleness (likely more so than inner material 102). According to embodiments, outer material 104 has a greater flexibility and softness as compared to inner material 103. Outer material 104 may, according to certain embodiments, have an end-to-end length in the range of the length of inner material 102. The length of outer material 104 may vary depending upon the nature of caps 106. Accordingly, inner material 102 is primarily encased in an even more flexible outer material 104 and caps 106.

Outer material 104 has an exterior surface that is configured to engage with the surface of an object encompassed by device 100 when device 100 is in at least a partially wrapped frictional fit configuration with the object. Further, in preferred embodiments of the invention, the outer diameter of inner material 102 is as large as or larger than the inner diameter of outer material 104. As such, a force fit connection between outer surface of inner material 102 and the inner surface of outer material 106 is created. Such a force fit may reduce or eliminate the need to have an adhesive or other means of fixing the positioning of inner material 102 and outer material 104 relative to each other.

In certain embodiments, device 100 is designed such that it can be easily wrapped onto an object, while also being unwrapped from said object with ease. In a wrapped state, the design of device 100 keeps the device attached (e.g., by friction fit) to the object to a sufficient degree, such that device 100 (or its components) does not move relative to the object when the object is used (e.g., device 100 remains stationary on a baseball bat during batting practice). These advantageous features are created, at least in part, due to the specific length, pliability, and overall design of the device, as further described below.

According to certain embodiments, inner material 102 is positioned to be surrounded in its entirety by outer material 104. Further, inner material 102 is fixed within device 100, for example, as discussed above, which eliminates extraneous internal movement or vibration that would have an impact upon the movement of the object around which device 100 is wrapped. Furthermore, fixation of inner material 102 eliminates extraneous internal movement or vibration when the object around which device 100 is wrapped is used. For example, such a configuration prevents movement of inner material 102 when the object around which device 100 is wrapped is a baseball bat, and the bat makes contact with a baseball. Also, with the unified configuration of device 100 the desired weight can be reached and maintained without the use of multiple and separate weight elements.

According to embodiments of the invention, the outer diameter of outer material 104 is selected according to the intended use of device 100. For example, the outer diameter and wall thickness of outer material 104 may be selected based upon the application of its use. For use of device 100 when the user is engaging in batting practice, for example, a relatively larger wall thickness is more desirably because such thickness helps dampen or control vibrations when the baseball bat encounters a baseball. Such wall thickness could thus be, according to embodiments of the invention, approximately 0.31 inches for device 100 used with a baseball bat, relative to approximately 0.375 inches for use on a human wrist, approximately 0.188 inches for a lacrosse stick, approximately 0.125 inches for a tennis and other racquet, and approximately 0.06 inches for a golf club.

Nitrile rubber ("NBR") is an example of a material that can be used for outer material 104, according to embodiments of the invention. Such a material provides the added benefit of vibration dampening. This type of material also allows device 100 to absorb vibrations due to impact, while also applying sufficient frictional forces between the object and device 100 so as to not uncoil in response to such vibrations. According to these embodiments, device 100 reduces the sting of hitting a baseball with a baseball bat. Anecdotally, the reduction of the 'sting' from the impact of the baseball bat and ball may very well build confidence in younger players (i.e., they can swing and hit with less pain in their hands). It is conceivable that the use of a material such as NBR for outer material 104 will also allow for less reduction in wrist and ankle blood circulation when device 100 is attached at those locations.

According to embodiments of the invention, device 100 includes caps 106 or such other desirable closing elements to, in part, help ensure inner material 102 stays within the outer ends of outer material 104. Depending on the desired fit of caps 106 with device 100, caps 106 could cover a desired portion of the ends of outer material 104, fit within the inner diameter of such ends, or be aligned so that the surface of the opening of caps 106 is flush with the ends of outer material 104. In preferred embodiments of the invention, caps 106 are made of PVC Vinyl and fit over approximately 0.75 inches of the ends of outer material 104. The inner diameter of caps 106 are sized to create a frictional fit with the outer diameter of outer material 104. One of ordinary skill in the art would realize that, for example, an adhesive could also be used in lieu of or in addition to such a frictional fit to secure caps 106 to outer material 104 and to complete the encapsulation of inner material 102. Preferably, caps 106 have a minimal weight relative the rest of the elements of device 100, prevent or reduce the exposure of the inside of the outer material 104 (inclusive of inner material 102) from outside conditions (e.g., water), and prevent the exposure and the protrusion of inner material 102.

One of ordinary skill in the art would realize that the weights of inner material 102, outer material 104 and caps 106 will have an impact on the weight of device 100. It is possible, according to embodiments of the invention, to adjust the weight of device 100 (e.g., making it heavier or lighter). To make the weight of device 100 heavier, an inner material that weighs more is selected for use inside of outer material 104. Additionally, the weight of the device may be increased by using a version of outer material 104 that is relatively heavier. An increase in the weight to caps 106 could also increase the overall weight of device 100. One of ordinary skill in the art would realize that the increasing of the weight of two of the three elements mentioned here could result in a heavier weight of device 100 as well as the increasing in the weight of all three elements. Conversely, the weight of device 100 may be reduced by reducing the weight of the inner material, using a version of outer material that is lighter, or reducing the number of inner elements placed within the device.

Figure 2A:
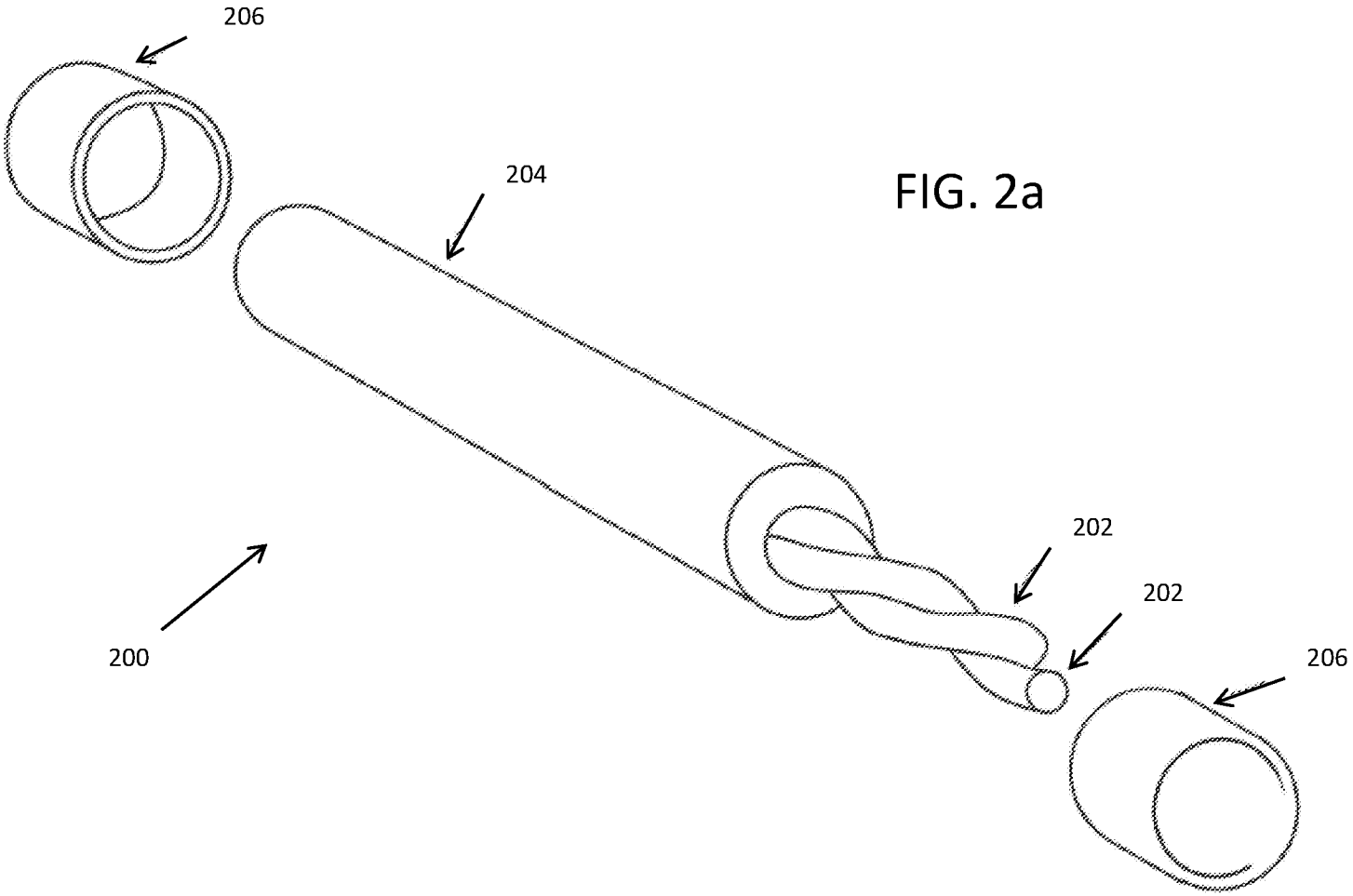
FIG. 2*a* is a partially exploded view of a device according to an embodiment of the invention in which two intertwined inner materials are shown as protruding from the space inside of the outer material.

FIG. 2*a* shows a partial exploded view of embodiments of the invention in which device 200 includes two inner materials 202 and is closed with caps 206. The use of two materials 202, such as, for example, the use of two lead rods of equal weight and pliability, gives device 200 more weight than if only one inner material 202 (e.g., one lead rod) is used, while simultaneously not proportionally or undesirably increasing the stiffness of device 200. In this embodiment, the inner diameter of outer material 204 may be larger to accommodate both inner materials 202, reducing the thickness of the outer material. Although FIG. 2*a* shows inner materials 202 intertwined, one of ordinary skill in the art would realize that inner materials 202 could be inserted with the intertwining, that there could be areas within the inner diameter of outer material 204 in which there could only be one inner material 202, that there may be areas therein where there could be more than two inner materials 202, that inner materials 202 may differ in weight, pliability and other characteristics, or that there may be a large number of configurations involving various aspects of inner material (s) 202. The weight of device 200 is variable based upon the number of individual inner material 202 balanced against their pliability in the aggregate—with the most desirable range for device 200 being, for example, in ounces as opposed to pounds. For example, using multiple lead rods allows for added weight without sacrificing the flexibility of device 200. It is more difficult to bend a ⅜" lead rod that weights 8 oz. than to bend two 5⁄16" lead rods that have a combined weight of 8 oz.

Figure 2B:
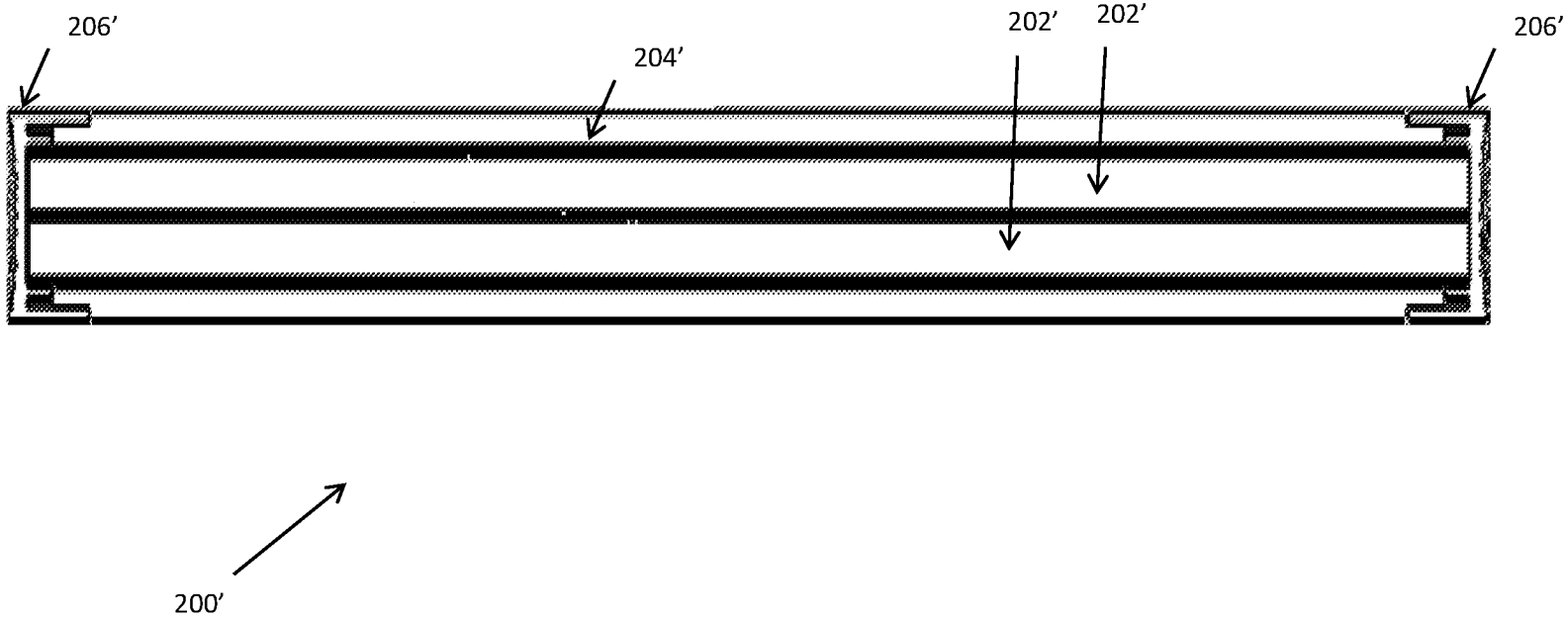
FIG. 2*b* is a cross-sectional view along a longitudinal axis of a device according to an alternative embodiment of the invention in which two inner materials are shown parallel to each other.
Figure 2C:
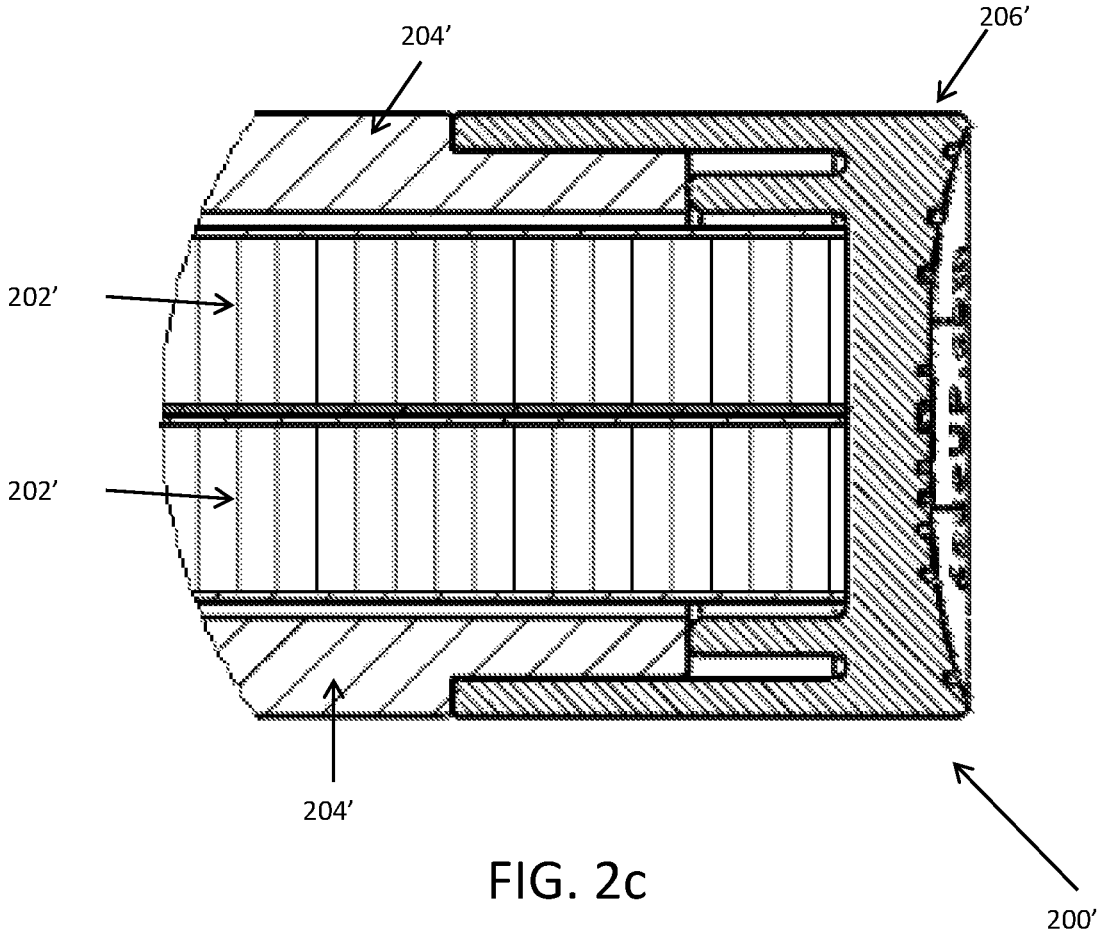
FIG. 2*c* is a magnified view of a portion of the cross-sectional view of FIG. 2*b*.
Figure 2D:
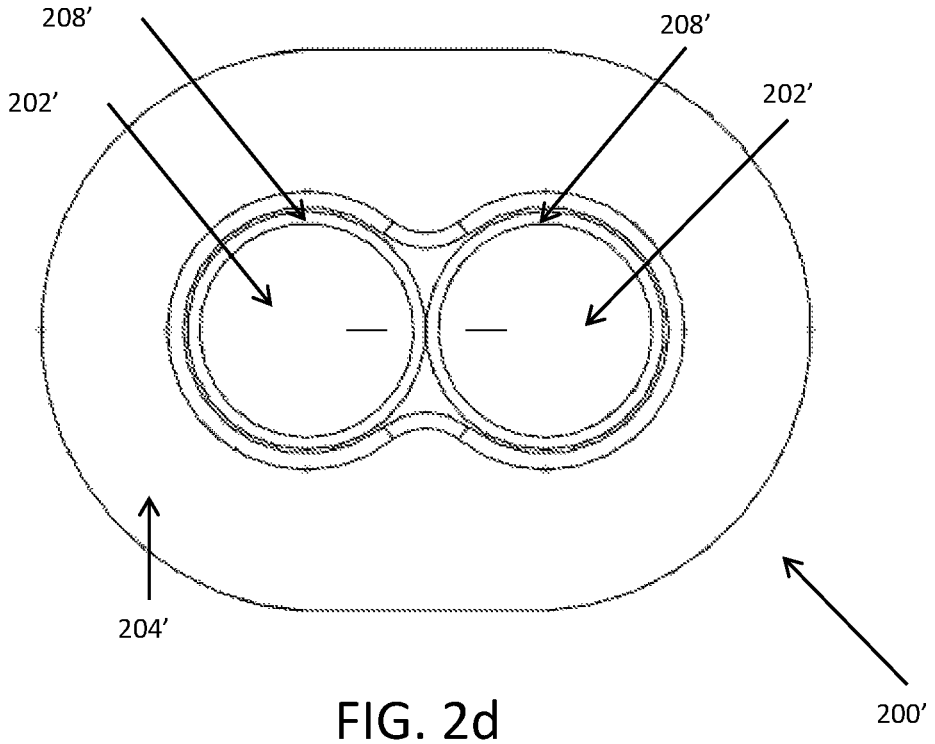
FIG. 2*d* is a transverse cross-sectional view of a device according to embodiments of the invention.

FIG. 2*b* shows a cross-sectional view of embodiments of the invention in which device 200' includes two parallel inner materials 202' and is closed with caps 206'. FIG. 2*c* is a magnified view of a portion of the cross-sectional view of FIG. 2*b*. The use of two materials 202', such as, for example, the use of two lead rods of equal weight and pliability, gives device 200' more weight than if only one inner material 202' (e.g., one lead rod) is used, while simultaneously not proportionally or undesirably increasing the stiffness of device 200. In these embodiments, the inner diameter of outer material 204' may be larger to accommodate both inner materials 202, reducing the thickness of the outer material. According to these embodiments, two inner materials 202' are located parallel to each other within outer material 204'. Similar to the above-mentioned embodiments, the weight of device 200' is variable based upon the number of individual inner material 202' balanced against their pliability in the aggregate—with the most desirable range for device 200' being, for example, in ounces as opposed to pounds. For example, using multiple lead rods allows for added weight without sacrificing the flexibility of device 200'. It is more difficult to bend a ⅜" lead rod that weights 8 oz. than to bend two 5⁄16" lead rods that have a combined weight of 8 oz.

As illustrated in FIG. 2*c*, at each end of device 200' cap 206' may interface and seal against outer material 204'. In embodiments of the invention, caps 206' extend along and abut a shouldered portion of outer material 204'. In this way, caps 206' may be sealed against outer material 204', ensuring that inner material 202' is adequately fixed within device 200' and is not exposed to the environment.

FIG. 2*c* illustrates a transverse cross-sectional view of a device according to embodiments of the invention. As previously discussed, the lead rod used as inner material 202' may be coated to protect the user of device 200 from unwarranted lead exposure (e.g., encased in a sealant). According to certain embodiments, coating 208' is placed on the exterior surface of inner materials 202'. In certain embodiments, coating 208' takes the form of a polymeric coating or other coatings that can sufficiently adhere to inner material 202'. According to preferred embodiments, coating 208' may take the form of heat shrink tubing or other heat-contractible material. According to these preferred embodiments, the inner diameter of coating 208', prior to heat shrinking, is approximately two to three times the outer diameter of inner material 202'. In addition to protection, coating 208' advantageously reduces the maximum bend angle that inner material 202' experiences during use, thus increasing the longevity of the device.

As also illustrated by FIG. 2*c*, the inner diameter of outer material 204' generally conforms to the outer diameter of coatings 208' (e.g., takes a figure eight shape), once said coatings are applied to the inner materials 208'. As also previously discussed, the inner diameter of outer material 204' may smaller than the outer diameter of coatings 208', such that the inner materials 202' are force fit within the device.

FIGS. 3*a*, 3*b* and 3*c* show inventive device 300 used in connection with lacrosse stick 302. In FIG. 3*a*, device 300 is positioned in the closest proximity to netting frame 306—just above center holding hand 304 of the user. Device 300 thus supplies additional weight near the netting of standard/regulation lacrosse stick 302, while not interfering with the netting area. As such, the user may exercise his or her muscles during practice time while using his or her normal lacrosse stick equipped with device 300. When device 300 is positioned as shown in FIG. 3*b*, just below the normal gripping area of center holding hand 304 (approximately in the center of the staff of lacrosse stick 302), the activation and exercising of the muscles change with the change in the added weight to a different location of lacrosse stick 302. Still a different experience is achieved when device 300 is wrapped around lacrosse stick 302 just above the normal gripping area of end holding hand 308 (as seen in FIG. 3*c*).

Figure 4A:
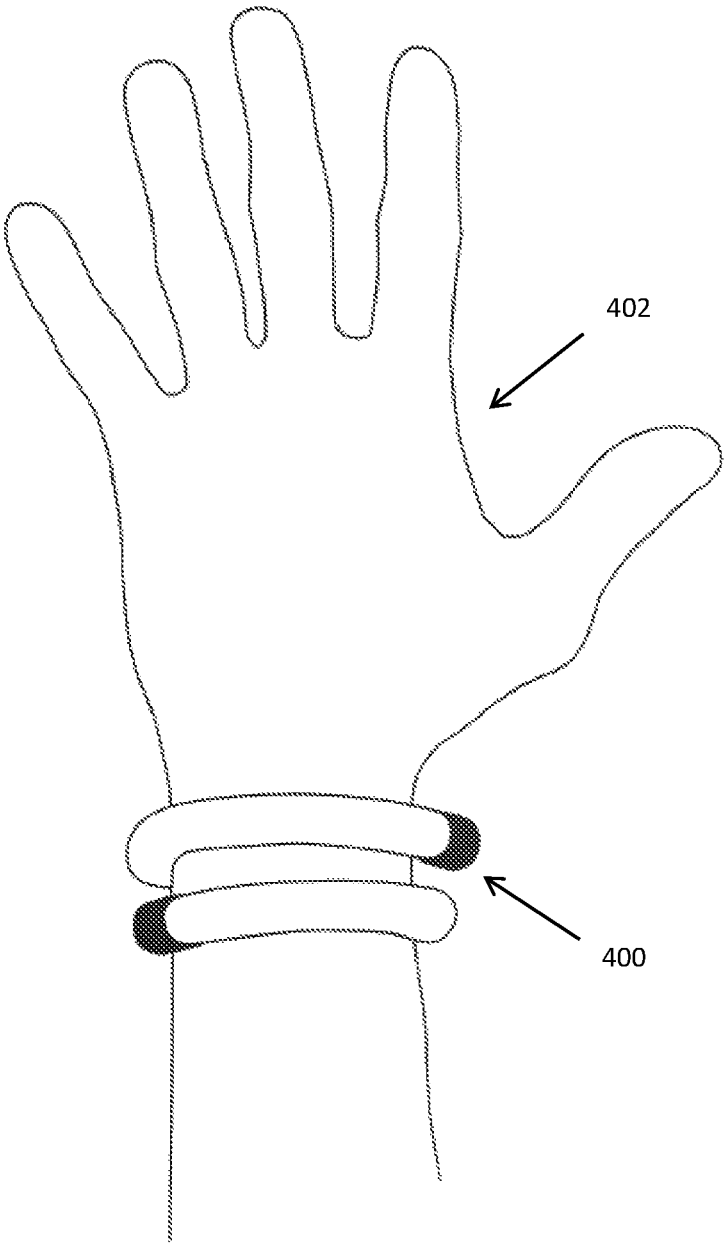
FIGS. 4*a* and 4*b* are views of the device attached to a wrist and hand portion of a human body and an ankle and foot portion of a human body, respectively, according to embodiments of the invention.
Figure 4B:
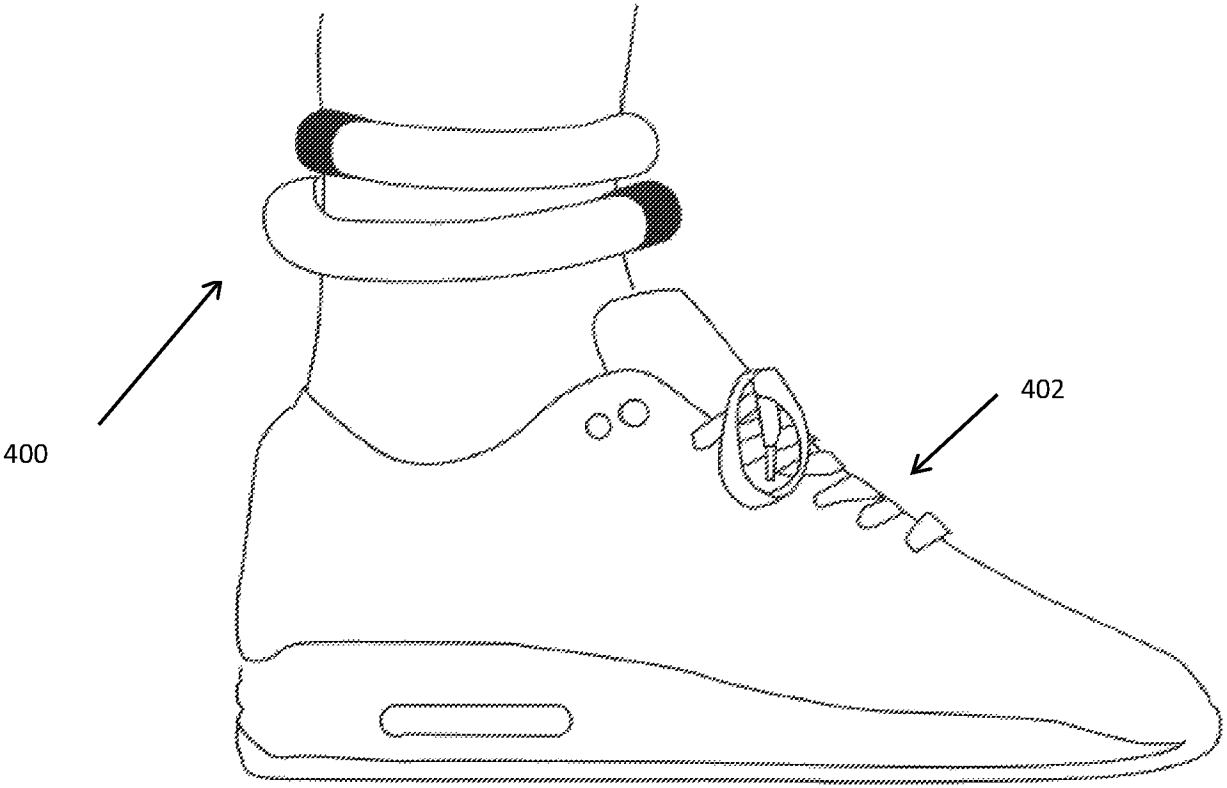

FIGS. 4*a* and 4*b* show inventive device 400 affixed to human body parts. FIG. 4*a* shows an embodiment of device 400 wrapped around the wrist of a user with hand 402. As stated elsewhere herein, this positioning of device 400 activates and/or exercises the muscles of the user while allowing for normal use of the hand 402. Whether exercising by running or jogging, going through one's normal day-to-day activities, or seeking to reduce or eliminate tremors, this positioning of device 400 assists with the exertion of weight induced forces. FIG. 4*b* shows device 400 wrapped around the ankle of a user with foot 404. Similar to the use of device 400 in proximity to hand 402, the wrapping of device 400 around the user's ankle assist in the exertion of weight induced forces that activate and/or exercise, at a minimum, the muscles of the user's leg.

The present invention also includes a method of exercising the muscles of the human body by adding weight to an object using a pliable device that is desirably configured and sized. The method includes the steps of: (A) establishing the desired level of weight-induced force to be exerted in influence of the motion of the object to promote the desired level of activation and/or exercise from the combined motion of such object and such device; (B) determining, based upon such desired force, the configuration of: (1) the weight of such device; (2) the location of such device relative to the surface of such object to optimize the use of such object in such object's normal activities; and (3) the dimensions of such device that would allow such device to be wrapped around such object at such location for the exertion of such forces; (C) selecting a version of such device with the desired weight for such location and with a desirable outer surface that can maintain a friction fit between such object and such device wherein such device stays relatively in close proximity to such location during such combined motion of such object and such device; (D) wrapping such device around such object at such location using the level of human force that is used in other day-to-day activities; and (E) moving the combination of such object and such device as desired to activate and/or exercise the desired muscles of the human body.

The device with a desirable configuration and size may be a pliable cylinder filed with at least one coated, lead rod and with a rubber outer covering and end caps. The critical dimension of the device is its length. It needs to be long enough to wrap around the object at the designated location so the frictional fit caused by the connection between the surface of the object at the location and the surface of the device are sufficient to keep the device in place during the movement of the object/device combination.

As mentioned above, one practice of this method is in the reduction of tremor. In this particular practice of the present inventive method, the method includes the steps of: (A) establishing the desired level of weight-induced force to be exerted to reduce the tremors to the desired level(s); (B) determining, based upon such desired force, the configuration of: (1) the weight of the pliable device; (2) the location of such device relative to the surface of a limb to which the device will be attached; and (3) the dimensions of such device that would allow such device to be wrapped around the limb at such location for the exertion of such forces; (C) selecting a version of such device with the desired weight for such location and with a desirable outer surface that can maintain a friction fit between such limb and such device wherein such device stays relatively in close proximity to such location during such combined motion of such limb and such device; (D) wrapping such device around such limb at such location using the level of human force that is used in other day-to-day activities; and (E) moving the combination of such limb and such device as desired to activate and/or exercise the desired muscles of the human body.

Another practice of the method is in the exercising of muscles during day-to-day activities (e.g., resistance) or in the intensifying of base exercise activities (e.g., jogging, biking, etc.) where, the present invention includes the steps of: (A) establishing the desired level of weight-induced force to be exerted in influence of the motion of the limb(s) in connection with the desired activity; (B) determining, based upon such desired force, the configuration of: (1) the weight of the pliable device; (2) the location of such device relative to the surface of such limb(s) to be exercised; and (3) the dimensions of such device that would allow such device to be wrapped around such limb(s) at such location for the exertion of such forces; (C) selecting a version of such device with the desired weight for such location and with a desirable outer surface that can maintain a friction fit between such limb(s) and such device wherein such device stays relatively in close proximity to such location during such combined motion of such limb(s) and such device; (D) wrapping such device around such limb(s) at such location using the level of human force that is used in other day-to-day activities; and (E) moving the combination of such limb(s) and such device as desired to activate and/or exercise the desired muscles of the human body.

Still another practice of the method is in the during training with other apparatus, such as, for example, lacrosse sticks, bats, golf clubs, tennis rackets etc. In this case, the present invention also includes a method of exercising the muscles of the human body during the use of the specified sports equipment by adding a pliable device that is desirably configured and sized to achieve the objective of the exercise. The method includes the steps of: (A) establishing the desired level of weight-induced force to be exerted in influence of the motion of the sports equipment to promote the desired level of activation and/or exercise from the combined motion of such sports equipment and such device; (B) determining, based upon such desired force, the configuration of: (1) the weight of such device; (2) the location of such device relative to the surface of such sports equipment to optimize forces exerted in the use of such sports equipment in such sports equipment's normal 'game play' activities; and (3) the dimensions of such device that would allow such device to be wrapped around such sports equipment at such location for the exertion of such forces; (C) selecting a version of such device with the desired weight for such location and with a desirable outer surface that can maintain a friction fit between such sports equipment and such device wherein such device stays relatively in close proximity to such location during such combined motion of such sports equipment and such device; (D) wrapping such device around such sports equipment at such location using the level of human force that is used in other day-to-day activities; and (E) moving the combination of such sports equipment and such device as desired to activate and/or exercise the desired muscles of the human body.

As discussed above, the device has been designed to easily wrap (and unwrap) from an array of objects. The materials and dimensions of the device have been selected to allow it to add weight to the object at various locations desired by a user. As an illustrative example of at least some of these benefits and advantages, a user may wrap the device around a location of a baseball bat. The specific design of the device allows it to be wrapped at various locations on the bat (e.g., locations along the bat's length). Once wrapped, the added weight provides benefits during batting practice (or other similar activities) by exercising muscles of the user. Additionally, the outer material of the device provides the benefit of vibration reduction when the bat strikes a baseball (i.e., the user's hands experience less "sting" when batting). Moreover, the device is designed such that forces imposed upon the device during batting (or other activities) do not displace the device relative to the bat. In other words, the device of the present invention has been designed such that it maintains an adequate frictional fit with the a bat (or other object) during repeated use. Such a benefit ensures that the user can carry out batting practice (or other activities) without the need to reposition the device every time a baseball is struck by the bat. These advantages equally apply to numerous other activities (e.g., lacrosse practice, hockey practice, etc.).

The above embodiments are merely illustrations of the device and method claimed herein. The invention also includes other embodiments not specifically disclosed above, embodiments which one of ordinary skill in the art would realize and envision as equivalents or derivations of the embodiments shown as existing in other specific forms without departing from its spirit or essential attribution. Numerous variations may be made within the scope of this invention and without sacrificing its chief advantages. Thus, the terms and expressions have been used as terms of description and not terms of limitation. Instead, reference should be made to the appended claims, rather than to the foregoing specification and drawings, as indicating the scope of the device and method inventions.

What is claimed is:

1. A device for activating and exercising human muscles while at least partially wrapped around an object, comprising:

a plurality of flexible inner materials, each of the plurality of flexible inner materials are in an elongated form and having a first end and a second end;

an elongated outer material surrounding the plurality of flexible inner materials, the elongated outer material having a first end and a second end, wherein the first end of the elongated outer material is located proximal to the first ends of the plurality of flexible inner materials and the second end of the elongated outer material is located proximal to the second ends of the plurality of flexible inner materials;

a first closing element proximal to the first ends of the plurality of flexible inner materials and the first end of the elongated outer material;

a second closing element proximal to the second ends of the plurality of flexible inner materials and the second end of the elongated outer material; and a coating on at least one of the plurality of flexible inner materials, wherein the coating comprises a heat-shrinkable material, wherein the plurality of flexible inner materials comprises two flexible inner materials, wherein the two flexible inner materials contact each other along a center of the device, wherein the two flexible inner materials create a space above or below the center of the device, and wherein at least a portion of the elongated outer material is located within the space.

2. The device recited in claim 1, wherein at least one of the plurality of flexible inner materials comprises a lead rod.

3. The device recited in claim 2, wherein the lead rod is shaped as a cylinder.

4. The device recited in claim 1, wherein an outer diameter of the plurality of flexible inner materials is equal to or larger than an inner diameter of the elongated outer material.

5. The device recited in claim 4, wherein the plurality of flexible inner materials is positioned to be surrounded entirely by the elongated outer material.

6. The device recited in claim 1, wherein the first closing element and the second closing element are caps.

7. The device recited in claim 6, wherein the caps are made of polyvinyl chloride.

8. The device recited in claim 1, wherein the device is configured to be at least partially wrapped around the object, and wherein the object has a circumference that is greater than a circumference of an outer surface of the device.

9. The device recited in claim 8, wherein the device is configured to be unwrapped such that the device is configured to be readily returned to its original configuration.

10. The device recited in claim 1, wherein the device is at least twelve inches long and is configured to wrap three times around the object when the object has a diameter of one inch.

11. The device recited in claim 1, wherein the elongated outer material is nitrile foam rubber.

12. The device recited in claim 1, wherein the plurality of flexible inner materials are parallel to each other.

* * * * *